US005530231A

United States Patent [19]

Walters et al.

[11] Patent Number: 5,530,231

[45] **Date of Patent: *Jun. 25, 1996**

[54] MULTILAYER FUSED MICROWAVE CONDUCTIVE STRUCTURE

[75] Inventors: Glenn J. Walters, Duxbury; John A. McCormick, Lakeville, both of Mass.

[73] Assignee: Advanced Deposition Technologies, Inc., Taunton, Mass.

[ * ] Notice: The term of this patent shall not extend beyond the expiration date of Pat. No. 5,412,187.

[21] Appl. No.: 432,492

[22] Filed: May 1, 1995

Related U.S. Application Data

[63] Continuation-in-part of Ser. No. 187,446, Jan. 25, 1994, Pat. No. 5,412,187.

[51] Int. Cl.[6] ..... H05B 6/80

[52] U.S. Cl. ..... 219/730; 219/728; 426/107; 426/243; 99/DIG. 44

[58] Field of Search ..... 219/728, 730; 426/107, 109, 234, 241, 243; 99/DIG. 14

[56] References Cited

U.S. PATENT DOCUMENTS

| | | | |
|---|---|---|---|
| 4,320,274 | 3/1982 | Dehn | 219/10.55 |
| 4,883,936 | 11/1989 | Maynard et al. | 219/730 |
| 4,904,836 | 2/1990 | Turpin et al. | 219/10.55 |
| 4,992,636 | 2/1991 | Namiki et al. | 219/10.55 |
| 5,079,397 | 1/1992 | Keefer | 219/10.55 |
| 5,173,580 | 12/1992 | Levin | 219/10.55 |
| 5,185,506 | 2/1993 | Walters | 219/10.55 |
| 5,220,143 | 1/1993 | Kemske et al. | 219/10.55 |
| 5,260,537 | 11/1993 | Beckett | 219/728 |
| 5,278,378 | 1/1994 | Beckett | 219/728 |
| 5,354,973 | 10/1994 | Beckett | 219/730 |
| 5,412,187 | 5/1995 | Walters et al. | 219/728 |

FOREIGN PATENT DOCUMENTS 2072286 12/1992 Canada .

OTHER PUBLICATIONS

In re Blamer, 93–1108 (CAFC 1993), Decision cites USPTO BPAI decision of Jul. 29, 1992 in Appeal No. 92–1802, Invention of Blamer is characterized in this decision.

*Primary Examiner*—Philip H. Leung
*Attorney, Agent, or Firm*—Wolf, Greenfield & Sacks

[57] ABSTRACT

A conductive structure for use in microwave food packaging which adapts itself to heat food articles in a safer, more uniform manner is disclosed. The structure includes a conductive layer disposed on a non-conductive substrate. Provision in the structure's conductive layer of fuse links and base areas causes microwave induced currents to be channeled through the fuse links, resulting in a controlled heating. When over-exposed to microwave energy, fuses break more readily than the conductive base areas resulting in less absorption of microwave energy in the area of fuse breaks than in other regions where fuses do not break. The arrangement and dimensions of fuse links compensate for known uneven stresses in the substrate, giving uniform fuse performance. In addition, by varying the dimensions of the fuse links and base areas it is possible to design and fabricate different fused microwave conductive structures having a wide range of heating characteristics. Thus, a fused microwave conductive structure permits food heating temperatures to be tuned for food type.

9 Claims, 6 Drawing Sheets

MULTILAYER FUSED MICROWAVE CONDUCTIVE STRUCTURE

CROSS-REFERENCE TO RELATED APPLICATION

This is a continuation-in-part of the Applicants' prior co-pending application Ser. No. 08/187,446, filed Jan. 25, 1994, and due to issue May 2, 1995 as U.S. Pat. No. 5,412,187.

FIELD OF THE INVENTION

The present invention relates generally to the field of microwave conductive structures for improving the cooking, heating or browning of food in microwave ovens. More particularly, the invention relates to articles usable in conventional food packaging which interact with electromagnetic energy generated by the microwave oven and adapt to different microwave oven types, food compositions and food geometries.

BACKGROUND

An example of a microwave conductive structure is a microwave susceptor which is an article which absorbs microwave energy, converts it into heat and conducts the heat generated into food articles placed in close proximity thereto. Microwave susceptors are particularly useful in microwave food packaging to aid in browning or crisping those foods which are preferably prepared by a method which browns or crisps the food.

The field of microwave conductive packaging technology includes numerous attempts to optimize heating, browning and crisping of food cooked in microwave ovens. Such attempts include the selectively microwave-permeable membrane susceptor shown in prior U.S. Pat. No. 5,185,506, issued Feb. 9, 1993 and U.S. Pat. No. 5,245,821 issued Oct. 19, 1993. Other attempts include a microwaveable barrier film described in U.S. Pat. No. 5,256,846 issued Oct. 26, 1993 and a microwave diffuser film described in U.S. Pat. No. 5,300,746 issued Apr. 5, 1994. U.S. Pat. Nos. 5,185,506 and 5,245,821 disclose examples of constructions which modify the overall heating pattern in a microwave oven in an attempt to optimize the heating for a specific food product and geometry. However, these and conventional microwave susceptor structures do not adequately address the heating problems associated with non-uniform electromagnetic fields found in all microwave ovens.

The unpredictability of the microwave field within a microwave oven is a significant problem for articles and methods which attempt to make heating, browning or crisping of food uniform. There are more than 500 models of microwave ovens on the market today, all of which have different heating patterns and non-uniform energy fields. Since most food products themselves are non-uniform in size and shape, there is an increased natural tendency of food to heat unevenly. The inability to adequately predict locations of hot spots and cold spots within a microwaved, packaged food item including a susceptor has made this area the subject of much research. For example, fishsticks or french fries loosely packaged in a box containing a six-inch by six-inch susceptor on the bottom, are often not properly crisped during cooking. Food items shield the susceptor from microwave energy, absorbing energy during microwave heating of the food. After exposure to the microwave field in a microwave oven, there will thus be noticeable differences in the heat generated by the 36-inch square susceptor, depending on the location of the food product. For instance, wherever the food product does not cover the susceptor material, the susceptor will get extremely hot, often hot enough to cause damage to the package. Indeed, it has been reported that susceptor packages have caught fire in consumer microwave ovens. In summary, susceptor areas not covered by the food product get extremely hot. At the edges of the food product, the susceptor will also reach extremely high temperatures. However, the susceptor material near the center of the food product will reach a much lower temperature. The net result is that the heat gain of the susceptor is not balanced over the susceptor area.

Therefore, a need exists for a microwave conductive structure which exhibits enhanced safety and performance over existing commercial microwave susceptors, and also for a microwave conductive structure which adapts itself in a controlled manner on the basis of the oven, food geometry, food location and food composition, so as to provide more uniform heating, browning and crisping of food products.

SUMMARY OF THE INVENTION

The above general goals and such other goals as will be obvious to those skilled in the art are met in the present invention, wherein there is provided a fused microwave conductive structure.

A fused microwave conductive structure for use in food packaging may comprise a substrate layer and an electrically conductive layer deposited on a surface of the substrate layer. The conductive layer has fuse links with connect adjacent conductive base areas. Base areas serve as conductive paths between fuse links, and act in connection with the fuse links to generate heat on exposure to microwave energy. Base areas are less susceptible to breaking upon exposure to microwave energy than the fuse links, which are substantially susceptible to such breaking. A wide variety of shapes and sizes of both the fuse links and base areas are possible. In accordance with various aspects of the present inventions, fuse link shapes, sizes and orientations balance susceptibility of fuse link breakage to exposure to microwave energy over the structure.

BRIEF DESCRIPTION OF THE DRAWING

Embodiments of the present invention will now be discussed in connection with the figures. Like reference numerals indicate like elements in the figures, in which.

DETAILED DESCRIPTION

The present invention will be better understood in view of the following description, read in connection with the figures.

Figure 2:
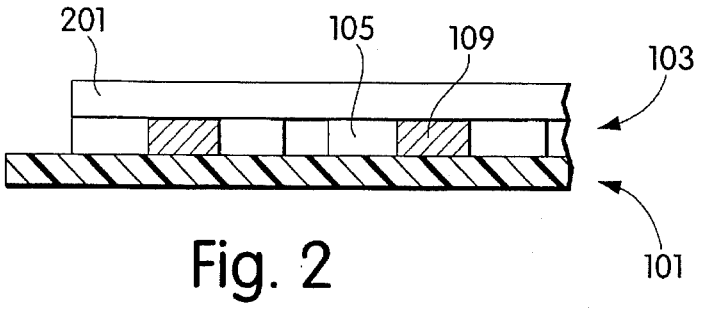
FIG. 2 is a section of the embodiment of FIG. 1A, taken along line 2—2.

Microwave conductive structures, including microwave susceptors used in food packaging generally include a non-conductive substrate (FIG. 2, 101) suitable for contact with food, on which a conductive layer (FIG. 2, 103) is disposed. The structure may be covered with one or more additional layers of non-conductive material. Commonly, the non-conductive substrate (FIG. 2, 101) and the conductive layer (FIG. 2, 103) are laminated to a material whose size and shape is more temperature stable, such as paper, paperboard or cellophane (FIG. 2, 201). Microwave energy impinging on such a structure induces currents within the conductive layer. The currents are dissipated by the resistance of the conductive layer as heat energy, which may be conducted into food articles placed on or near the structure. The present invention is of this general type.

Figure 1A:
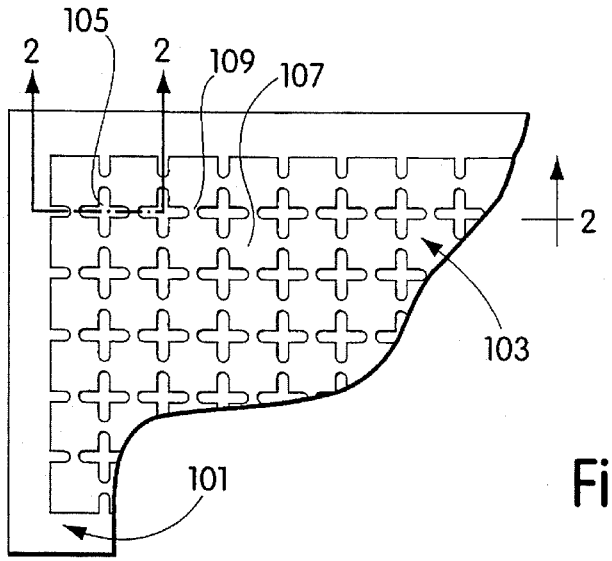
FIGS. 1A, 1B and 1C are conductive structure patterns according to various embodiments of the present invention.

The present invention is now generally described in connection with FIGS. 1A–1C. FIG. 1A shows a fused microwave conductive structure comprised of a paper or plastic substrate, generally designated 101, and a electrically conductive layer, generally designated 103. The layers 101 and 103 may be more clearly seen in the cross-section of FIG. 2. The structure may be covered with a dimensionally stable material (FIG. 2, 201) of paper, paperboard or cellophane, for example. For clarity, the dimensionally stable material (FIG. 2, 201) is omitted from all top views.

The substrate layer 101 may be made of any plastic conventionally used for food packaging purposes and which is not susceptible to damage during microwave cooking or as a result of the application of a thin film of metal or other conductive material. For example, the substrate may be biaxially oriented polyethylene terephthalate (PET), polyethylene napthalate (PEN), polycarbonate, nylon, polypropylene or another plastic approved for direct food contact. The conductive layer 103 may be formed of any metal or alloy conventionally used for microwave conductive structures. The conductive layer 103 should have a surface resistivity in a range of about 10Ω/□ to 1000Ω/□. Advantages of the present invention may include, but are not limited to greater or lesser heat flux than current susceptors, safer more uniform heating and lower and higher temperature conductive structures. Suitable metals include aluminum, iron, tin, tungsten, nickel, stainless steel, titanium, magnesium, copper and chromium or alloys thereof. The conductive layer 103 may include metal oxide or be partially oxidized or may be composed of another conductive material, so as to adjust the layer properties.

Conductive layer 103 is provided with a plurality of non-conductive areas 105, such as apertures or areas of non-conductive materials, conductive base areas 107 and fuse links 109, for example. The fuse links 109 connect base areas 107 each to the other.

The base areas, 107, can be large enough to function individually as inefficient microwave susceptors, but should not be so large as to function individually as efficiently as a conventional sheet susceptor. Alternatively, they can be too small to individually act as microwave susceptors and heat up significantly on exposure to microwave energy. However, a group of such areas, whether large or small, linked together by fuse links 109, converts microwave energy into heat overall similarly to a large conventional susceptor. As will be explained in greater detail, below, heat generation of such a susceptor including fuse links 109 is concentrated to a greater or lesser degree in the fuse links 109, depending upon the geometry of those fuse links 109. As will also be explained in greater detail below, if one area (FIG. 3, 300*a*) of the susceptor is over-exposed to microwave energy, fuse links in that area will break, isolating that area from other areas (FIG. 3, 300*b*) of the conductive structure. As a result, those areas (FIG. 3, 300*a* and 300*b*) will operate less effectively as a microwave susceptor.

Failure of the fuse links is a function of the supporting substrate, the thickness of the conductive layer 103, the constituent material of the conductive layer, the dimensions of the pattern defining the fuse links 109 and the dimensions of the base areas 107 as well as variables related to the food, the location of the food within the oven cavity and the oven type. Furthermore, fuse links may develop small cracks that permit displacement currents to flow through the cracks possibly in a capacitive coupling fashion, before failing entirely. This, and other factors, discussed below, permit the design of fast and slow fuses, and high heating and low heating fuses. Pattern dimensions and corresponding fuse link behavior is presently determined on an empirical basis. Fuse links covering an area of about 0.1 $mm^2$ to 20 $mm^2$ are suitable.

Hotter susceptors are possible using the present invention, because the sheet resistance of a susceptor constructed with fuses is higher than that of a susceptor constructed of a similar thickness layer of metal, but without fuses. The apertures through the metal layer, which define the fuse links 109 and base areas 107 are non-conductive. Therefore, current flow is restricted to the areas of the fuse links 109 and base areas 107. This restriction of current flow is due to an effectively higher sheet resistance. The sheet resistance of a susceptor is also related to the surface impedance of the susceptor at the frequencies of operation in microwave ovens, and power transfer from one transmission medium to another depends upon the matching of the impedances from one medium to another. The impedance of air is relatively high at the frequencies of interest. Therefore, by raising the sheet resistance of the susceptor and consequently raising the surface impedance, a better match to the air is achieved. Thus, more power is transferred into the susceptor, which converts the microwave energy received into heat. By orienting the fuses to avoid placement along the axis of greatest stretch of the substrate, the fuses may be set for a higher heat, without breaking, than would be achieved by a conventional susceptor, which would begin to break when the recoil forces began to rupture the film.

Cooler susceptors are also possible using the present invention. Fuses break when the local temperature reaches the temperature at which the substrate recoil force grows large enough to break the fuse. The fuses may be set to break at relatively low susceptor surface average temperatures, thus limiting the overall heat generated by the susceptor structure, by making the fuses relatively small. A cooler susceptor may use relatively small base areas, for example about 2–3 mm on a side, having a relatively heavy deposition of metal, for example reaching an optical density of about 0.45. In a conventional susceptor, such a thick layer of metal would be subject to relatively rapid, uncontrolled breakage, due to rapid heating from high currents generated. However, the fused susceptor according to the present invention would break down in a controlled fashion, at a controlled temperature. By using small, thick base areas, the susceptor could continue to operate at a lower efficiency, providing a low, but steady heat to the food.

Figure 8:
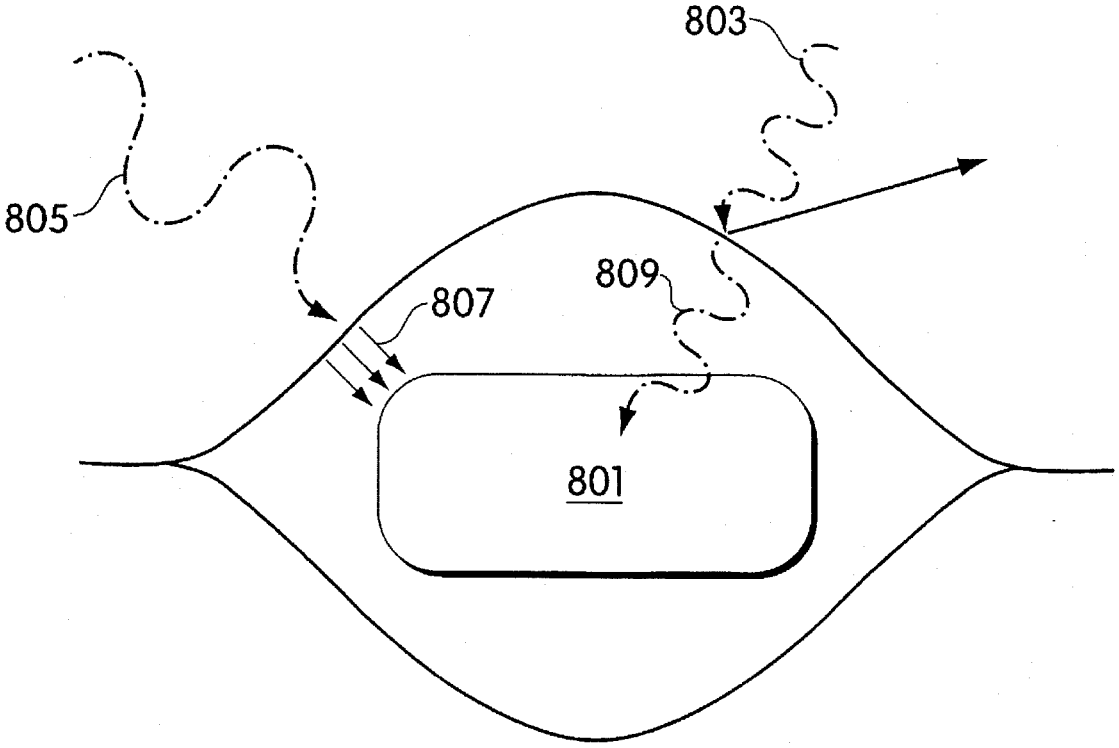
FIG. 8 is a schematic representation of cooking a food item in a wrap according to one aspect of the present invention.

The present invention, when embodied as described above using a relatively thick metal layer, is advantageously used in a bag or wrap configuration, as shown schematically in FIG. 8, with the food 801 placed in the center. In such an application, the relatively thick metal layer reflects some of the microwave energy impinging on it 803. An additional quantity of microwave energy 805 is absorbed by the metal layer and converted to heat 807 which is conducted to the food surface. A small remaining quantity of microwave energy 809 passes through the metal layer to cook the interior of the food. Such operation is particularly suitable for food items which are susceptible to overcooking by microwave and which require crisping or browning at high temperature, such as filled pastries and some meats.

A number of patterns have been proposed. For example, the patterns shown in FIGS. 1B and 1C will produce different degrees of heating of food articles and fuse links, both before and after fuse links break. The pattern of FIG. 1B may be characterized as having slow, hot fuses 109, whereas the pattern of FIG. 1C may be characterized as having fast, cool fuses 109. This difference in fuse behavior arises as follows.

Fuse links function as conventional fuses; that is, a fuse with a larger conductive cross-section than a second fuse requires greater current to fail than that required to make the second fuse to fail. With the same conductive layer thickness, wider fuse links having corresponding larger cross-sectional areas and connecting adjacent base areas, fail at higher temperatures than narrower fuse links due to increased current capacity. These wider fuse links also take longer to reach failure temperature. In FIG. 1B, the fuse is wider than the distance between opposite edges of the adjacent non-conductive area, resulting in a slow, hot fuse. In FIG. 1C, the fuse is narrower than the distance between opposite edges of the adjacent non-conductive area, resulting in a fast, cool fuse, because the current carrying capacity of the fuse is decreased. The fuse design rules discussed with respect to these patterns are applied to make fuse breakage uniform across the structure as described later.

Figure 3:
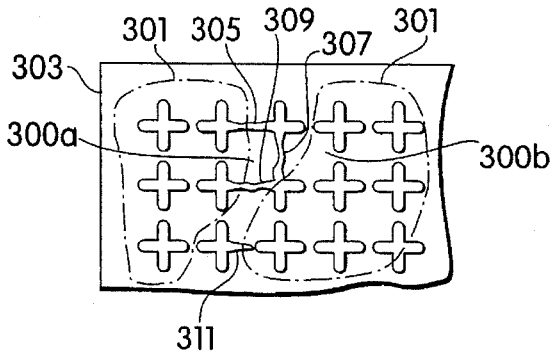
FIG. 3 is a top view of a conductive structure which has been exposed to microwave energy, while food is present thereon.

In FIG. 3, the effect of irregularly shaped food articles on a conductive structure according to the present invention is seen. Food articles 301, shown in phantom, are placed on a conductive structure 303, in accordance with the present invention. Fuse links 305, 307 and 309 are exposed directly to microwave energy. Therefore, they break, isolating portions 300*a* and 300*b* of the conductive structure 303 from one another. The microwave energy absorbed in the region near broken fuse links 305, 307, 309 and subsequently converted into heat is reduced. Fuse link 311, being partially covered by a food article 301 has partially broken. Thus, microwave heating of those areas of conductive structure 303 has been partially reduced. Since less microwave energy is absorbed by the regions of conductive structure 303 where fuses have broken, the solid regions of conductive structure 303 under food articles 301 now absorb relatively more microwave energy and produce more heat. Therefore, the effectiveness of conductive structure 303 in the areas covered by food articles 301 has been enhanced.

In addition to the variables discussed above, failure of the fuse links is a function of the relationships between non-conductive areas 105, fuse links 109 and base areas 107 and the polymeric substrate (FIG. 2, 101), as now discussed.

A biaxially oriented polyethylene terephthalate (PET) film is a polymeric film which has been stretched in two orthogonal directions. The two directions are usually the machine direction, i.e., the direction of film travel, and the across-the-web direction, i.e., perpendicular to the machine direction. Stretching a crystalline or partially crystalline film and then rapidly cooling or quenching the film imparts several beneficial physical characteristics to the film such as increased strength and yield (measured in square inches of film produced per pound of raw material). Typically the film is stretched more in one direction than the other. However, if the oriented film is brought above its orientation temperature, then it tends to shrink to its former size. Such films exhibit a greater recoiling or shrinkage force in the direction of greater stretch than in the other direction. The shrinkage is due to the stretched polymer chains recoiling, much like springs. Shrinkage can cause the PET film to rupture, and a small rupture can propagate. Ruptures and tears may disrupt susceptor operation by isolating some areas from others, resulting in uneven heating. In some cases, there may be excess heat build up in localized regions.

Figure 1B:
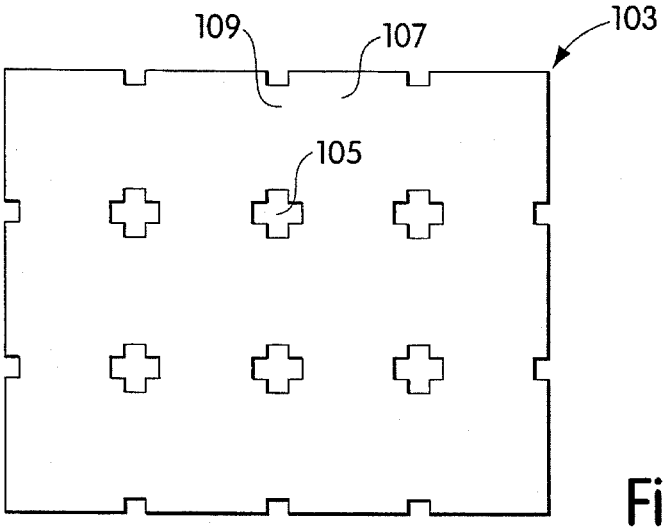
Figure 1C:
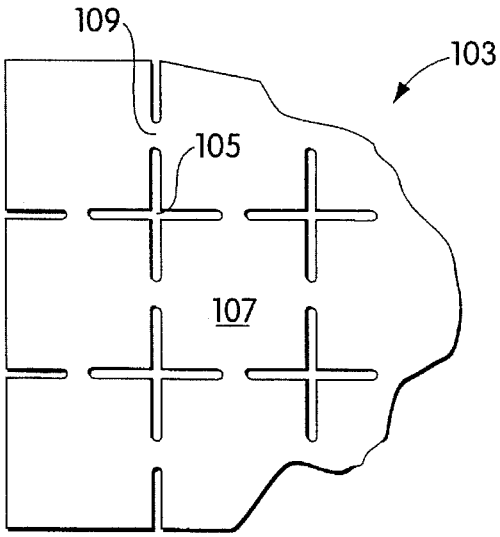

Consider a fuse susceptor pattern, as shown in FIGS. 1A, 1B or 1C deposited on a typical biaxially oriented film with all fuses being the same size and shape, and with fuses being aligned with the film's directions of stretch. When exposed to microwave energy, the fuses arranged between base areas aligned in the direction of greatest stretch will break before fuses aligned with direction of lessor stretch, due to the difference in recoil force generated upon heating. However, the fuse links of a fuse susceptor pattern, shown in FIG. 5, having its axes aligned 45° to the machine and across-the-web directions will break at substantially the same time, when illuminated with approximately the same quantity of electromagnetic energy, everything else also being equal. Furthermore, since the recoil force exerted upon the fuses aligned as described is less than conventionally aligned fuses, otherwise equivalent fuses aligned as described will break at a somewhat higher temperatures.

Figure 6:
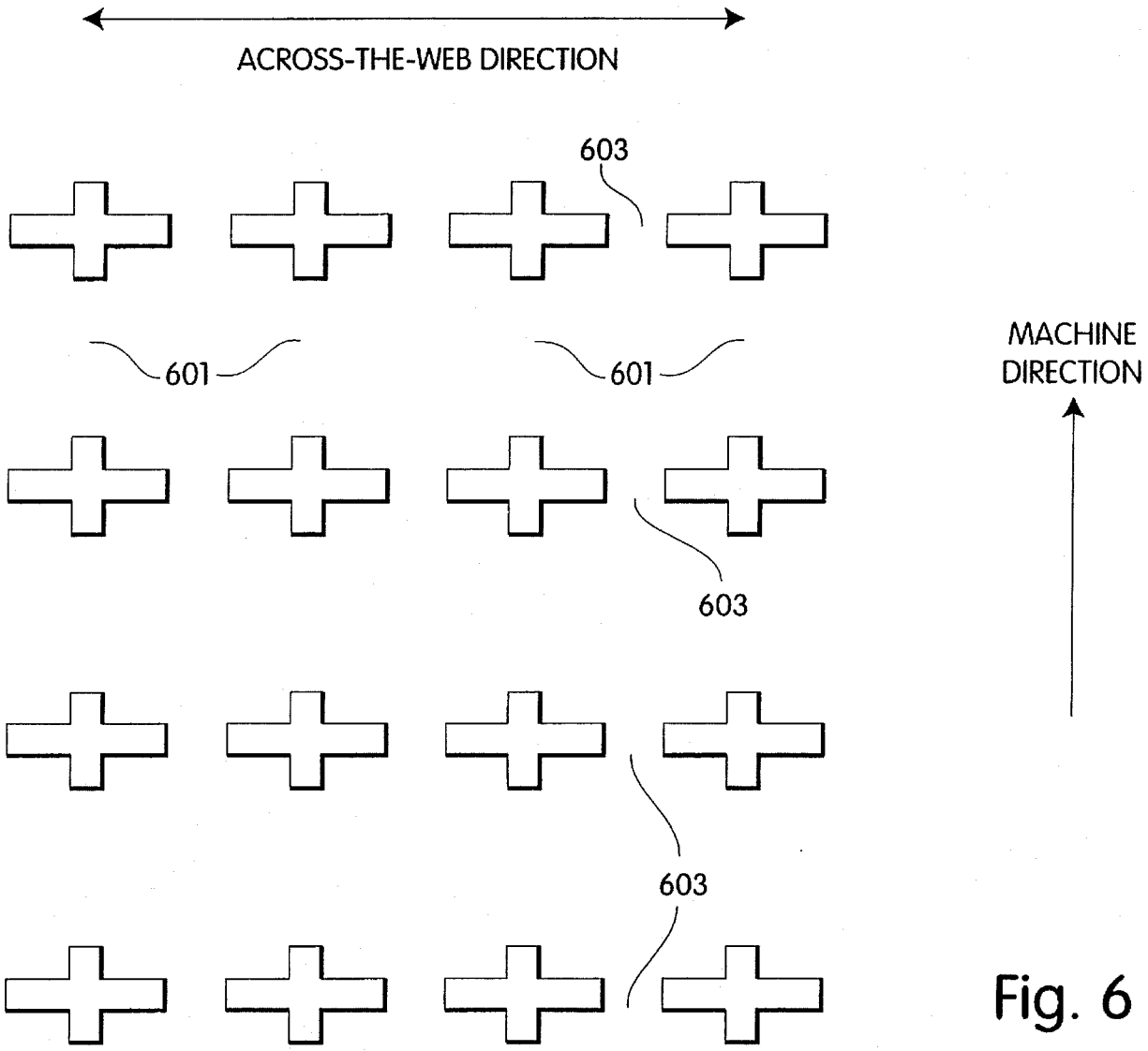
FIG. 6 is a top view of a conductive structure pattern which balances fuse breakage on a biaxially oriented substrate by fuse width.

Alternatively, in order to cause fuse links to break at substantially the same time after the same exposure to microwave energy, the fuse links could be aligned with the machine and across-the-web directions, as previously done, but with fuse links sized to compensate for the different shrinkage forces in the film as shown in FIG. 6. In FIG. 6, to increase their current carrying capacity, fuse links 601, aligned in the across-the-web direction are wider than fuse links 603, aligned in the machine direction.

Figure 5:
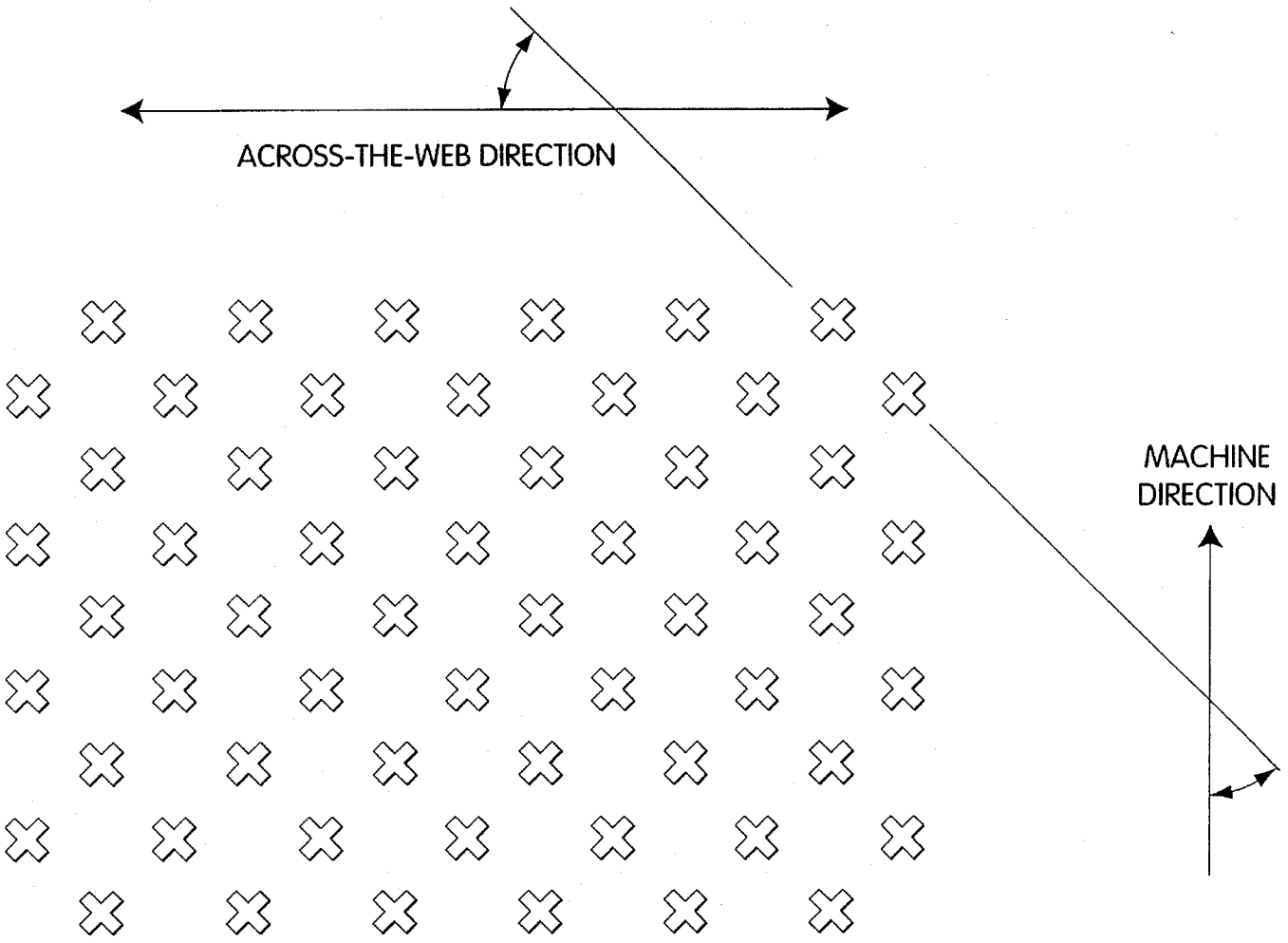
FIG. 5 is a top view of a conductive structure pattern which balances fuse breakage on a biaxially oriented substrate by fuse orientation.

Advantages of the present invention may include, but are not limited to, greater heat flux than current susceptors, safer, more uniform heating and achievement of both lower temperature and higher temperature conductive structures. By varying the fuse dimensions, different heating characteristics may be achieved. Small hot fuses may be made, which do not rupture the PET substrate, because they are not oriented on the weak axis of the substrate. Conversely, large cooler fuses which generate very uniform temperatures may be made, because the break points of fuses are made uniform by use of the invention. Aligning the fuse links at a 45° angle with the film's orientation directions, as shown in FIG. 5, directs the current and hence the heating away from the weakest direction of the polymeric substrate, resulting in a more robust fuse susceptor. The fuse links begin to break at higher temperatures than similar dimension fuses oriented with the direction of greatest stretch.

Figure 7:
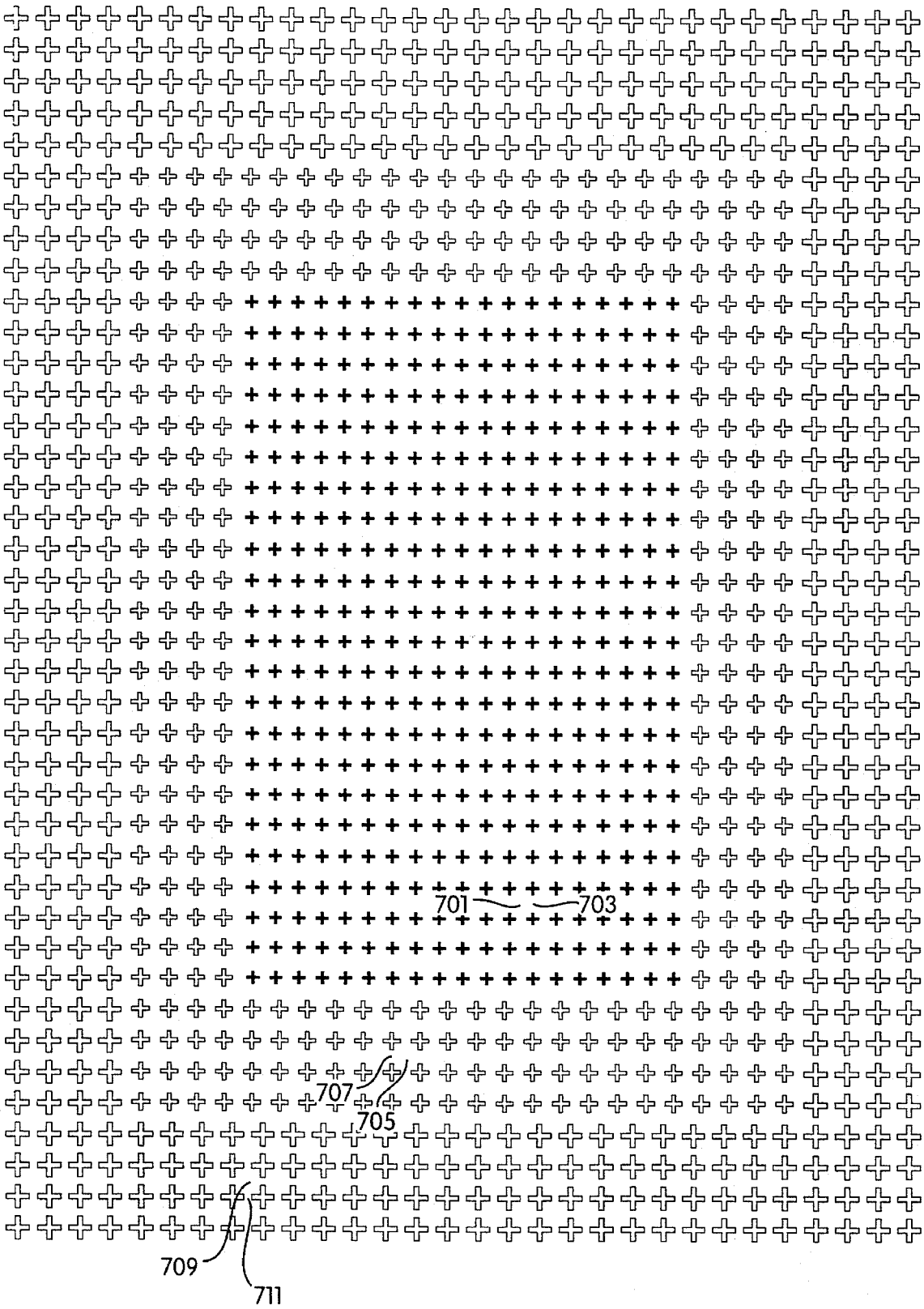
FIG. 7 is a top view of a conductive structure pattern whose heat generation is graded from the center to the edges.

The pattern of FIG. 7 includes these distinct regions, whose fuses and base areas have differing geometries. The center region is designed to have small base areas 701 and proportionally large, hot fuses 703. Thus, the center region provides the greatest heating effect to the food. The fuses 703 of the center region provide a safety mechanism which prevents overheating of this hot region. The middle band has somewhat larger base areas 705 than the center region, but the fuses 707 are a relatively smaller proportion of the size of the base areas 705 than in the center region. These design choices provide somewhat less heat than the center region, because the fuses 707 break at a lower temperature than fuses 703, but the base areas 705 nevertheless remain operative at a reduced efficiency after fuses 707 break. In the outer region are found the largest base areas 709 and the proportionally smallest fuses 711. As a result, the outer region provides the lowest heat generation. When the fuses 711 break, which here occurs at the lowest temperature, the base areas 709 operate as susceptors, but at a reduced efficiency. Thus, this design directs the greatest heat to the food region, while the edges remain somewhat cooler.

The material described in connection with FIG. 7 is particularly suitable for cooking foods like pizza, when made as described in connection with FIG. 8. Where food is in proximity with the susceptor material, the fuses tend not to break, but to continue to produce heat. Thus, the middle part of the pizza dough may be crisped, without burning the edges.

Figure 4:
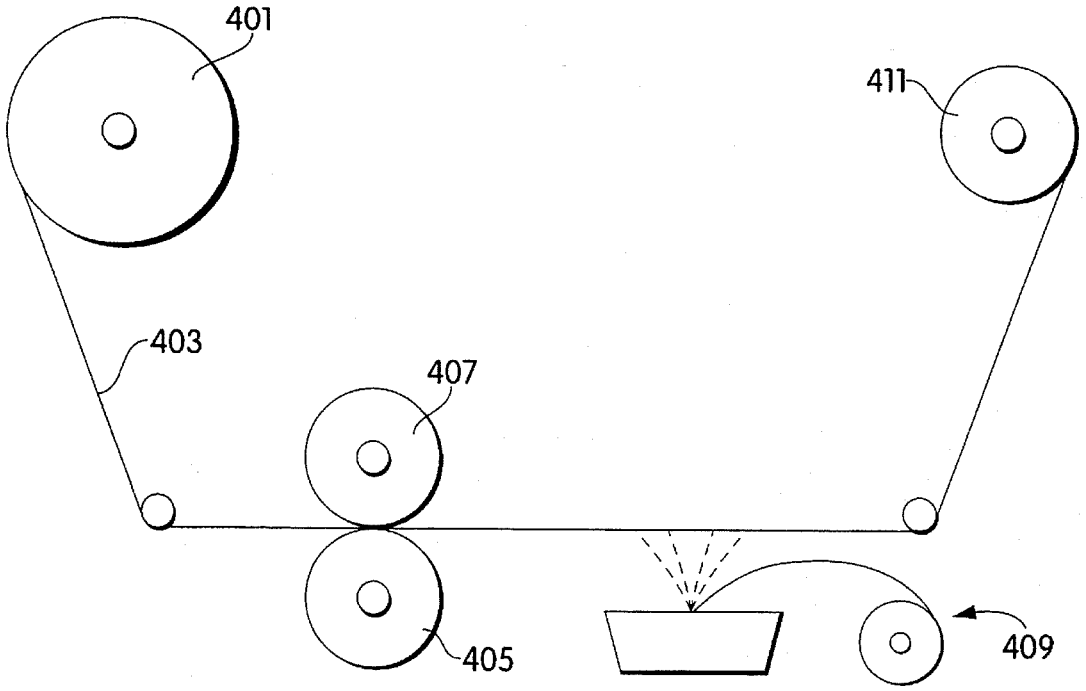
FIG. 4 is a schematic illustration flow chart of a method for making a conductive structure in accordance with one aspect of the present invention.

Conductive structures in accordance with the present invention may be made by a variety of methods known to those skilled in the art. In general, any method which can produce a thin pattern film of metal on a plastic substrate is suitable. For example, pattern printing and etching techniques are suitable. Another such method is now described in connection with FIG. 4.

In accordance with this method, there is supplied from a supply reel 401 a continuous web of plastic substrate 403. The plastic substrate 403 is passed between rollers 405 and 407 which cause to be printed on a bottom surface thereof a negative image in oil of the desired pattern. The plastic substrate 403 then passes above an aluminum deposition apparatus 409. The pattern of oil printed by rollers 405 and 407 locally prevents deposition of metal. Metal is, however, deposited to regions not covered by the oil. Thus, take-up reel 411 receives a substrate on which a conductive structure film has been deposited having, for example, one of the patterns shown in FIGS. 1A–1C.

Another example of a method for producing conductive structures according to the present invention is to deposit a uniform film of metal on a substrate and subsequently etch metal away to form the pattern required.

The present invention has now been described in connection with a number of specific embodiments thereof. However, numerous modifications which are contemplated as falling within the scope of the present invention should now be apparent to those skilled in the art. Therefore, it is intended that the scope of the present invention be limited only by the scope of the claims appended hereto.

What is claimed is:

1. A fused susceptor structure comprising:

a non-conductive substrate; and a conductive layer disposed on the non-conductive substrate;

the conductive layer divided into a plurality of fuse links and base areas by regions of substantially less conductivity than the conductive layer; wherein the fuse links are arranged in at least two orientations, and the fuse links of both orientations are equally susceptible to breaking upon exposure to microwave energy.

2. The fuse susceptor structure of claim 1, wherein the non-conductive substrate is:

a biaxially oriented substrate film.

3. The fuse susceptor structure of claim 2, wherein the substrate film has a greater shrinkage force along a first axis as compared to the shrinkage force along a second axis.

4. The fuse susceptor structure of claim 3, wherein the the fuse links have axes forming oblique angles with the axes of the substrate film.

5. The fuse susceptor structure of claim 3, wherein fuse links oriented along the first axis are larger than fuse links oriented along the second axis.

6. The fuse susceptor structure of claim 1, wherein the conductive layer is a layer of metal having an optical density substantially equal to 0.45.

7. A fused susceptor structure comprising:

a non-conductive substrate; and a conductive layer disposed on the non-conductive substrate;

the conductive layer divided into a plurality of fuse links and base areas by regions of substantially less conductivity than the conductive layer, wherein sizes of the fuse links and base areas are varied from one region to another region to cause greater heat generation in the one region than the other region upon exposure to microwave energy.

8. The fused susceptor of claim 7, wherein the base areas near a center of the susceptor are smaller than the base areas near an edge of the susceptor.

9. The fuse susceptor of claim 7, wherein a ratio of base area to fuse link width near a center of the susceptor is smaller than a ratio of base area to fuse link width near an edge of the susceptor.

* * * * *